United States Patent [19]

Franklin

[11] 4,021,139

[45] May 3, 1977

[54] GAS TURBINE GUIDE VANE

[75] Inventor: Clifford John Franklin, Winterthur, Switzerland

[73] Assignee: Brown Boveri Sulzer Turbomachinery, Ltd., Zurich, Switzerland

[22] Filed: Oct. 30, 1975

[21] Appl. No.: 627,367

[30] Foreign Application Priority Data

Nov. 8, 1974 Switzerland ..... 14952/74

[52] U.S. Cl. ..... 416/97 R; 415/115

[51] Int. Cl.[2] ..... F01D 5/18

[58] Field of Search ..... 416/95–97, 416/96 A; 415/115, 116

[56] References Cited

UNITED STATES PATENTS

| | | | |
|---|---|---|---|
| 3,032,314 | 5/1962 | David | 416/96 A |
| 3,475,107 | 10/1969 | Auxier | 415/115 |
| 3,560,107 | 2/1971 | Helms | 416/95 X |
| 3,567,333 | 3/1971 | DeFeo | 416/97 X |
| 3,574,481 | 4/1971 | Pyne et al. | 416/97 X |
| 3,799,696 | 3/1974 | Redman | 416/97 |
| 3,809,494 | 5/1974 | Redman | 416/97 |
| 3,930,748 | 1/1976 | Redman et al. | 416/97 A |

*Primary Examiner*—Everette A. Powell, Jr.
*Attorney, Agent, or Firm*—Kenyon & Kenyon Reilly Carr & Chapin

[57] ABSTRACT

The cooled vane includes an insert from which cooling air is dispersed over the inner wall of the vane to flow from the leading edge to the trailing edge via air channels between the jacket and insert and thence from the trailing edge via air channels to the leading edge and through outlets to flow over the suction side of the vane surface.

7 Claims, 3 Drawing Figures

GAS TURBINE GUIDE VANE

This invention relates to a gas turbine guide vane and particularly to a vane having means for cooling the interior of the vane.

Heretofore, gas turbine guide vanes or blades have been constructed, for example as described in U.S. Pat. No. 3,809,494, with an outer jacket, a hollow insert within the jacket and projections on the inner wall of the jacket against which the insert abuts to form channels extending from the leading edge of the vane towards the trailing edge of the vane. When in use, a flow of cooling air is conducted to first flow into the inner hollow space of the insert, and from there through openings in the insert and a turbulence space between the insert and leading edge of the vane to cause "impact cooling" of the leading edge. Thereafter, the air flows into the cooling-air channels formed between the projections to both sides of the insert. The air then exits through various openings in the trailing edge.

However, in such constructions, under certain assumptions, e.g. with relatively small quantities of cooling-air, and high temperatures at the outside of the vane, it is difficult to obtain uniform and adequate cooling in all regions of the vane.

Accordingly, it is an object of the invention to improve the cooling action of the known gas turbine blade or vane constructions particularly in the region of the trailing edge.

Briefly, the invention provides a gas turbine guide vane having a jacket disposed on a longitudinal axis to define a leading edge, a trailing edge, an internal wall defining a hollow cavity, a pressure side and a suction side. In addition, the vane has a hollow insert in the jacket cavity in spaced relation to the wall to define an air chamber therein and a turbulence space between the insert and jacket at the leading edge. A partition extends between the insert and wall parallel to the longitudinal axis of the vane at the leading edge on one side of the turbulence space. Also, openings in the insert at the leading edge communicate the air chamber with the turbulence space while projections on the jacket wall extend from the turbulence space towards the trailing edge on the pressure side to define air flow channels. Other projections extend from the trailing edge towards the partition on the suction side to define air flow channels. Also, outlets are provided in the trailing edge to communicate with the air flow channels on the pressure side to exhaust a portion of cooling air while other outlets e.g. holes are provided in the leading edge of the jacket to communicate with the air flow channels on the suction side to exhaust the remainder of the cooling air over the exterior of the jacket.

In use, the total quantity of cooling air from the turbulence-space first flows on the pressure side of the vane to the trailing edge. In comparison with the known construction, the cooling air, for the same absorption of heat, has a substantially lower temperature at the trailing edge. Because a portion of relatively cool air flows off through the trailing edge, it is thus possible to obtain improved cooling of the trailing edge. Further, because a relatively large pressure drop is still available due to the outlet holes in the jacket being in a region of relatively low static pressure close to the leading edge, the second portion, or remainder, of the cooling air flows from the trailing edge along the inner wall of the jacket on the suction side back to the leading edge. This second portion therefore has relatively large gas-velocity, through which as is well known heat-transfer is improved. Furthermore, this portion as with the known construction, flows as a cooling film on the outside of the vane back to the trailing edge. Whereas with the known construction the film flow and that on the inside run in the same direction, the flows in accordance with the invention flow in contrary directions. This results in a further improvement of the cooling action.

It is advantageous for the air outlet in the trailing edge and in the region of the suction side of the leading edge to be dimensioned so that about 50% of the total quantity of cooling air emerges out of the trailing edge.

The outer jacket of the vane is advantageously cast in one piece by the precision-molding process. The stiffness and strength of the mold's trailing edge core may be improved if the projections, provided in the inner wall of the outer jacket end at different distances from the trailing edge. This produces additional turbulences at the trailing edge which, in turn, improve the action of the cooling air at the trailing edge still further.

These and other objects and advantages of the invention will become more apparent from the following detailed description and appended claims taken in conjunction with the accompanying drawings in which:

FIG. 3 illustrates a view taken on line III—III of FIG. 2.

Figure 1:
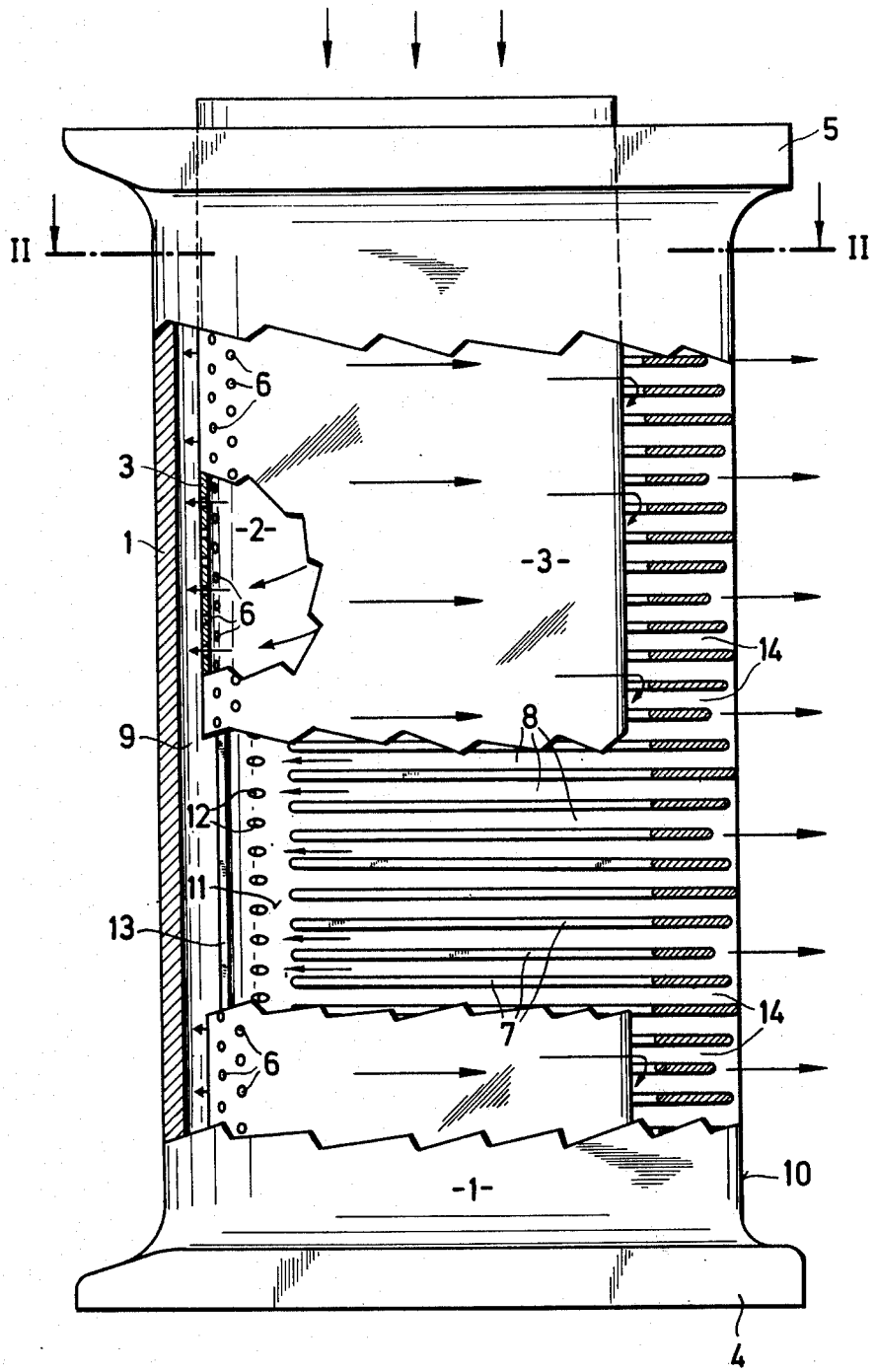
FIG. 1 illustrates a part-sectional view of a guide vane in accordance with the invention.

Referring to FIG. 1, the gas turbine guide vane includes an outer jacket 1 which imparts a stable shape and mechanical strength to the vane and which is preferably made as a one-piece precision casting. The jacket 1 defines the outer contour of the vane including a leading edge and a trailing edge as well as an inner wall defining a hollow cavity 2. A hollow insert 3 is pushed, for example through an open outer vane cover 5 at a housing from the outside into the cavity 2 and is fastened at the underside to an inner vane cover 4. To this end, the insert 3 includes a bottom which is secured, for example by brazing or soldering, to a sheet metal jacket which defines the wall of the insert 3. The insert also includes a stem or pin 5 on the bottom by which the insert 3 is secured to the inner vane cover 4. This one-sided attachment permits the insert 3 to expand freely at the housing side, i.e. in the region of the outer vane-cover 5 when heated. It is of course also possible to fasten the insert 3 in the outer, i.e. housing side, cover 5 or in both vane covers 4, 5.

The insert 3 is made elastic to sit against projections on the inner wall of the jacket 1. These projections in the example shown are made as ribs 7 which run, at least approximately, perpendicularly of the longitudinal axis of the vane. Of course, it is also possible to use, instead of ribs, other projections, such as bumps, knobs, webs or the like, and to dispose flow-paths therebetween for the cooling air at a desired angle to the vane axis. The abutment of the insert 3 against the ribs 7 can be improved advantageously by making the cooling air enter through the outer vane cover 5 directly into the inner hollow cavity 2 of the insert 3. The air then has a maximum pressure before pressure-losses occur during the flow through the vane.

Openings 6 are provided in the insert 3 in the leading edge region to place the inner hollow cavity 2 in flow-communication with a turbulence-space 9 provided between the outer jacket 1 and the insert 3. In this way, the leading edge of the vane is given a so-called impact-cooling by the air flowing from the inner cavity 2 into the turbulence-space 9.

Figure 2:
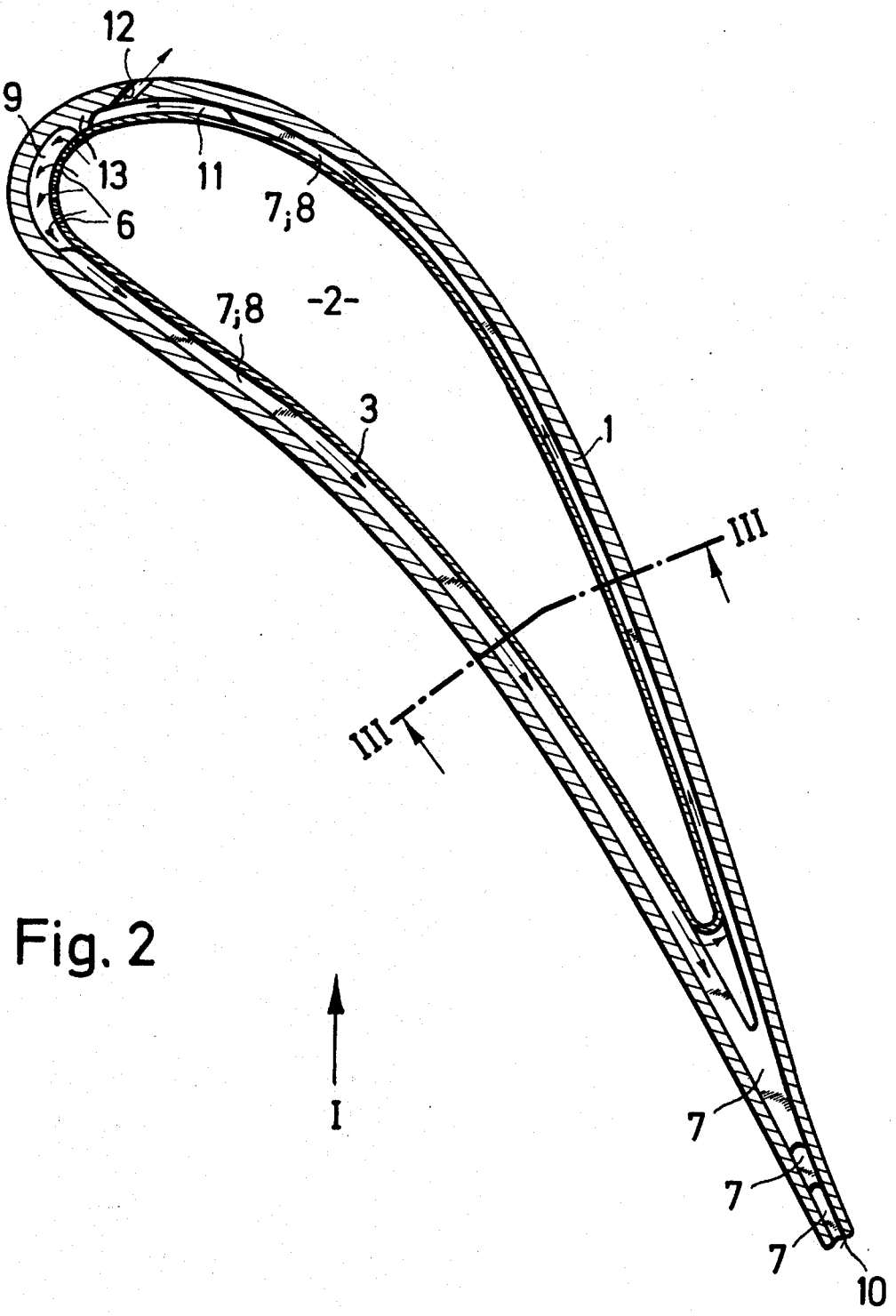
FIG. 2 illustrates a view taken on line II—II of FIG. 1.

Referring to FIG. 2, a partition 13 is disposed on one side of the turbulence space 9 between the insert 3 and jacket at the leading edge in parallel to the longitudinal axis of the vane. The partition 13 serves to block the flow of air from passing to the suction side of the vane. As shown, one set of projections or ribs 7 extend from the leading edge towards the trailing edge 10 on the pressure side while another set of projections extend from the trailing edge 10 towards the leading edge on the suction side. In addition, outlets 14 are formed in the trailing edge 10 to exhaust a portion of air received from the channels 8 on the pressure side of the vane while outlets 12 are provided in the leading edge to exhaust the remainder of air received via the channels on the suction side of the vane. In order to facilitate the exhaust of air via the outlets 12, a collection chamber 11 is disposed on the side of the partition 13 opposite the turbulence space 9 and between the channels and outlets 12.

In use, cooling air is delivered into the cavity 2. This air then flows via the openings 6 into the turbulence space 9. Next, the air flows via the channels 8 on the pressure side of the vane to the trailing edge 10 with a portion of the air being exhausted via the outlets 14 while the remainder flows through the channels 8 on the suction side to the collection chamber 11 at the leading edge and, thence, out of the outlets 12 over the exterior surface of the jacket 1 as a cooling film.

The outlets 14 in the trailing edge 10 are sized so that the cooling air flowing to the trailing edge 10 becomes divided, and approximately half flows off through outlets 14 while the remainder flows back on the suction side of the vane.

In order to match the flow speed of the diminished quantity of air at least approximately to that at the pressure side, the suction-side channels 8 have their cross-section reduced to about half that of the channels 8 on the pressure side, as shown in FIG. 3.

As shown in FIG. 1, the individual ribs 7 end alternately at different distances from the trailing edge 10. As already mentioned, this results in two main advantages. In the first place, the production of the cast outer jacket gives great strength to the trailing edge core of the mold. In the second place, the parts of the trailing edge 10 not occupied with ribs provide hollow spaces for the cooling air in which turbulence occurs to improve the cooling action.

What is claimed is:

1. A gas-turbine guide vane comprising a jacket disposed on a longitudinal axis and defining a leading edge, a trailing edge, an internal wall defining a hollow cavity, a pressure side and a suction side;

a hollow insert in said cavity disposed in spaced relation to said wall to define an air chamber therein and a turbulence space between said insert and said jacket at said leading edge;

a partition extending between said insert and said wall parallel to said axis at said leading edge on one side of said turbulence space;

a plurality of openings in said insert at said leading edge communicating said air chamber with said turbulence space;

a plurality of projections on said wall extending from said turbulence space toward said trailing edge on said pressure side to define air flow channels and from said trailing edge towards said partition on said suction side to define air flow channels;

a plurality of outlets in said trailing edge communicating with said channels on said pressure side to exhaust a portion of cooling air; and a plurality of outlets in said leading edge communicating with said channels on said suction side to exhaust the remainder of the cooling air over the exterior of said jacket.

2. A gas turbine guide vane as set forth in claim 1 which further comprises a collection space for air between said insert and said jacket on the side of said partition wall opposite said turbulence space and in communication with said channels and said outlets on said suction side.

3. A gas turbine guide vane as set forth in claim 1 wherein said outlets in said trailing edge are sized to exhaust approximately fifty percent of the cooling air flow passing through said channels on said pressure side.

4. A gas turbine guide vane as set forth in claim 1 wherein said projections on said pressure side terminate at different distances from said trailing edge.

5. A gas-turbine guide vane comprising a jacket disposed on a longitudinal axis and defining a leading edge, a trailing edge, an internal wall defining a hollow cavity, a pressure side and a suction side;

a hollow insert in said cavity disposed in spaced relation to said wall to define an air chamber therein and a turbulence space between said insert and said jacket at said leading edge;

a partition extending between said insert and said wall parallel to said axis at said leading edge on one side of said turbulence space to block a flow of air from passing to said suction side of said jacket;

a plurality of openings in said insert at said leading edge communicating said air chamber with said turbulence space;

a plurality of projections on said wall extending from said turbulence space toward said trailing edge on said pressure side to define air flow channels and from said trailing edge towards said partition on said suction side to define air flow channels;

a plurality of outlets in said trailing edge communicating with said channels on said pressure side to exhaust a portion of cooling air; and a plurality of outlets in said leading edge communicating with said channels on said suction side to exhaust the remainder of the cooling air over the exterior of said jacket whereby cooling air delivered to said cavity flows into said turbulence space and sequentially through said air flow channel on said pressure side to said trailing edge and thence through said air flow channels on said suction side to said outlets in said leading edge.

6. A gas turbine guide vane as set forth in claim 5 wherein said outlets in said trailing edge are sized to exhaust approximately fifty percent of the cooling air flow passing through said channels on said pressure side.

7. A gas turbine guide vane as set forth in claim 5 wherein said projections on said pressure side terminate at different distances from said trailing edge.

* * * * *